US006691374B2

(12) United States Patent
Coyne

(10) Patent No.: US 6,691,374 B2
(45) Date of Patent: Feb. 17, 2004

(54) EYEGLASSES HOLDER

(76) Inventor: Mark Coyne, 18135 W. Erik Ct. #274, Canyon Country, CA (US) 91351

( * ) Notice: Subject to any disclaimer, the term of this patent is extended or adjusted under 35 U.S.C. 154(b) by 0 days.

(21) Appl. No.: 10/173,934

(22) Filed: Jun. 18, 2002

(65) Prior Publication Data

US 2003/0229971 A1 Dec. 18, 2003

(51) Int. Cl.[7] ..... A44B 21/00; A45F 5/02

(52) U.S. Cl. ..... 24/3.3; 24/3.1; 24/3.12; 24/335; 24/336; 248/316.7; 248/902

(58) Field of Search ..... 24/3.3, 3.1, 3.12, 24/458, 335, 336; 248/316.7, 231.51, 902; 351/112, 157

(56) References Cited

U.S. PATENT DOCUMENTS

| | | | | | |
|---|---|---|---|---|---|
| 4,695,026 | A | * | 9/1987 | Medley, Jr. | 248/316.7 |
| 4,949,432 | A | * | 8/1990 | Wisniewski | 24/3.3 |
| 5,082,225 | A | * | 1/1992 | Nespoli | 248/316.7 |
| 5,137,242 | A | * | 8/1992 | Reath | 248/902 |
| 5,408,728 | A | * | 4/1995 | Wisniewski | 24/3.3 |
| 5,619,774 | A | * | 4/1997 | Perry | 24/3.3 |
| 5,653,414 | A | * | 8/1997 | Chimel | 248/316.7 |
| 5,975,476 | A | * | 11/1999 | Mancinelli | 248/316.7 |

* cited by examiner

*Primary Examiner*—Victor Sakran
(74) *Attorney, Agent, or Firm*—Birch, Stewart, Kolasch & Birch, LLP

(57) ABSTRACT

An eyeglasses holder that includes a frame and a displaceable holding member. The frame may be integrally formed from a single piece of flexible, resilient material such as plastic or metal. The frame includes a base section and a holding section. These sections are connected to one another at a first pair of their ends while a second end of one of the sections is separated the section to form an entrance. The sections define between them a receiving space that is opened at opposite sides. In one embodiment, the entrance is normally sufficiently closed to bar the crossed temple bars or arms of a pair of eyeglasses. The resiliency of the frame allows the entrance to be enlarged sufficiently to allow the arms to pass through the entrance and into the receiving space, and to later pass outwardly through the entrance. The holding member is supported by the frame in a position such that, when the arms are inserted into the space, the member is engaged and displaced by the arms, and the member exerts a frictional holding force on the arms which limits their movement. The member may take the form of one or more elastic bands, a spring, etc. In another embodiment the entrance may be fixed in an open condition which allows the arms to pass through, with the arms being retained in the space by the holding member. Here the frame need not be flexible and resilient. The frame may also include a support arrangement for releasibly mounting the holder as on the user's waistband.

49 Claims, 9 Drawing Sheets

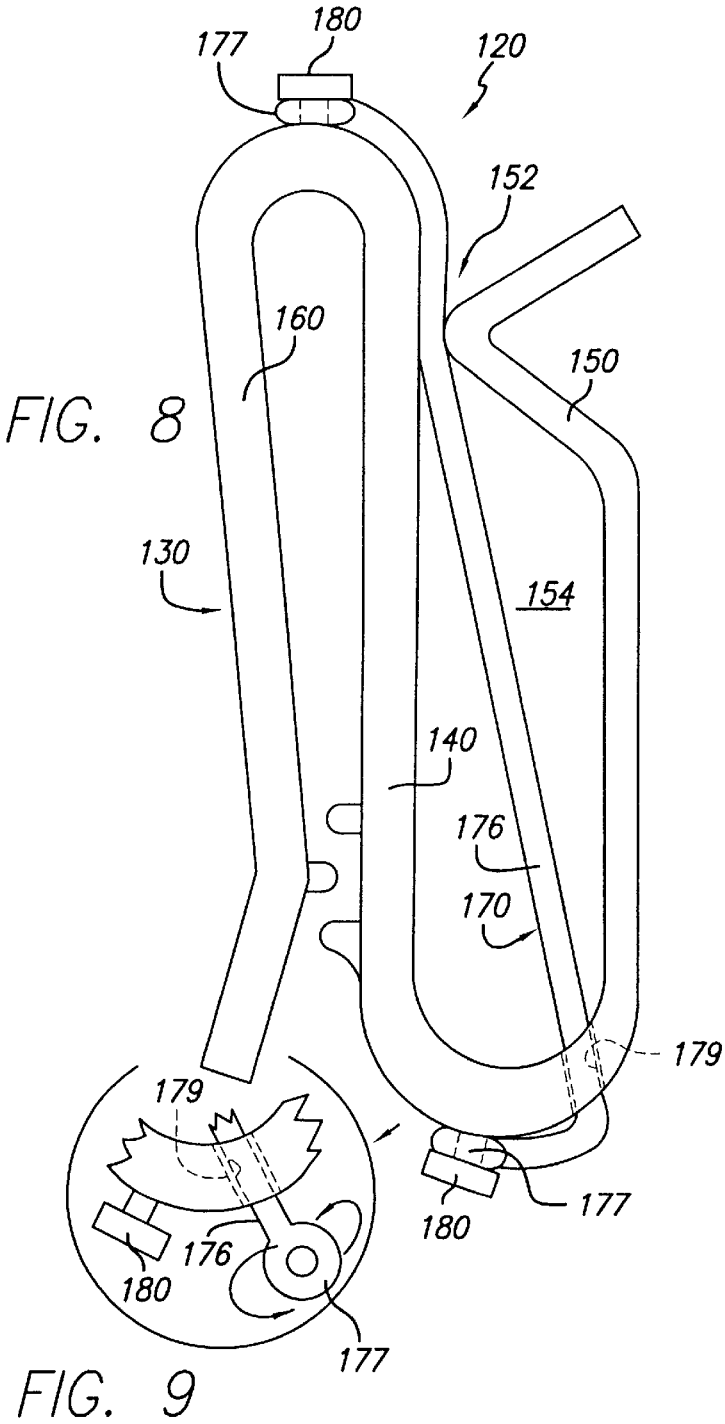
FIG. 8
FIG. 9
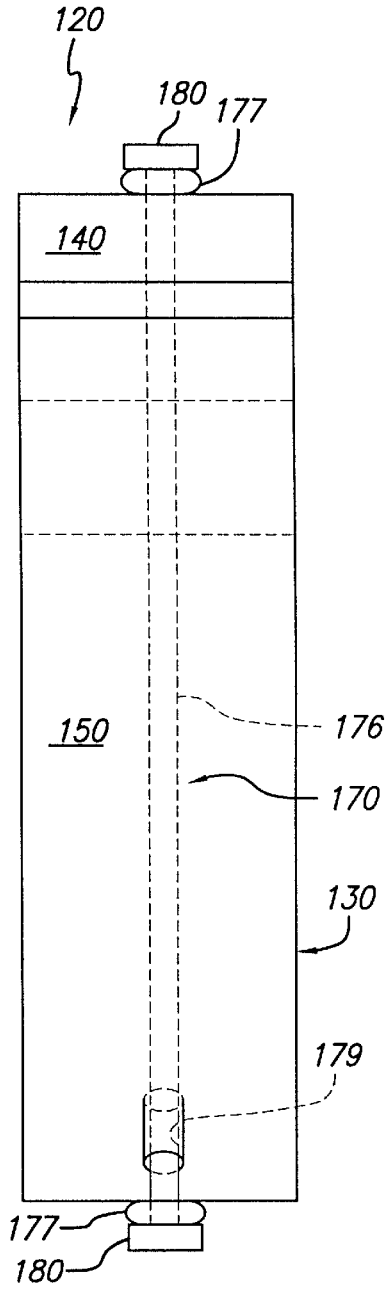
FIG. 10

620
630
680'
681
670a
667a'
650
670a'
670a''
680'
681
680'
681
680'
680''
652
654
630
680'
620
665
661
667
660
640
650
676
676
670a'
670a''
668
644
680'
680''
580'
581
530
520
570a'
570a''
550
576
576
581
580'
580''
554
576
576
550
576
576
580''
580'
552
520
580'
530
560
540
570a'
570a''
580'
580''
580'
581
530
520
570a'
570a''
570a''
570a'
550
576
576
581
58'
580'
580''
580'
580''
580'
580''

EYEGLASSES HOLDER

FIELD OF THE INVENTION

Devices for holding eyeglasses.

BACKGROUND OF THE INVENTION

There are many known devices for holding a pair of eyeglasses. Many of these are complex and costly, utilizing multiple parts. Others require a number of steps to attach and then subsequently detach the eyeglasses from the holder. Still others do not securely hold the eyeglasses so that there is a risk that the eyeglasses will too easily disengage from the holder and be lost or damaged. Still others hold the eyeglasses in a way that allows the eyeglasses to move around relative to the holder and/or allow the eyeglasses parts to move around relative to one another. There is also the problem with some holders that they have a tendency to mar or otherwise damage the eyeglasses in ordinary use. It is also often the case that the eyeglasses are held in such a way that the lenses of the eyeglasses can contact parts of the holder or the clothing of the user to smudge or harm the lenses.

SUMMARY OF THE DISCLOSURE

The illustrated eyeglasses holder or carrier is simple and efficient to manufacture and to use. It holds the eyeglasses firmly yet gently so that they tend not to rattle around, and so that they cannot readily, inadvertently become separated from the holder.

The illustrated eyeglasses holder includes a multi-section frame that is integrally formed from a single piece of flexible, resilient material such as plastic or metal. The illustrated holder also includes a displaceable holding or retaining member which is positioned to be engaged and displaced by the eyeglasses temple bars or arms so as to limit movement and prevent inadvertent separation of the arms from the holder. The illustrated frame includes a base section and a holding section which are generally aligned with one another. The base and holding sections are connected to one another at one or a first pair of ends while a second end of one of the sections is unconnected to the other section to form an entrance. The base and holder sections are configured so as to provide a receiving space that is open at either side and accessible through the entrance. In operation, the crossed arms of a pair of eyeglasses are moved through the entrance into the receiving space. In one embodiment, the entrance is normally sufficiently small to bar the eyeglasses arms, but the base and/or control sections are sufficiently flexible and resilient to allow the entrance to be enlarged sufficiently to allow the eyeglasses arms to pass through into the receiving space. The illustrated holder is designed so that the user can readily and easily press the arms into the entrance, thereby enlarging it and allowing the arms to pass through. The entrance then can return on its closed position which tends to prevent the arms from inadvertently exiting the receiving space. When the user wants to remove the eyeglasses from the holder, she simply and easily pushes the arms back to the entrance to again enlarge the entrance and allow the arms to pass through.

The illustrated holder is normally and preferably supported with the sides generally vertical and with the entrance at the top to further limit inadvertent movement of the eyeglasses arms out of the receiving space.

The holder may conveniently be supported as on the user's clothing. In one form, the frame has a support section which allows the holder to the clip onto the belt or waistband of the user in the desired vertical orientation.

One form of illustrated holding or retaining member is at least one elastic band mounted on the frame. The band extends in the end-to end direction it is positioned to be engaged by the eyeglasses arms, displaced and stretched. The arms thereby exert, in combination with the frame, a frictional holding force on the arms in the receiving space. This force tends to hold the arms in place, to prevent them moving about relative to one another or to the holder, and to restrict inadvertent separation of the eyeglasses from the holder. The drawings also illustrate the displaceable retainer member in the alternate form of a spring that may be either formed integrally with the remainder of the frame or a separate piece.

In one form the holder includes an internal projection that provides a partial division of the receiving space into a larger subspace for most eyeglasses and a smaller subspace for eyeglasses arms that are very thin such as those of the "wire" type.

IN THE DRAWINGS

FIG. 8 is a schematic side view of an alternate form of eyeglasses holder utilizing a single holding strand having a small connecting loop at either end.

FIG. 9 is a schematic partial view of the holder of FIG. 8, showing one end loop of the holding strand.

FIG. 10 is a schematic front view of the holder of FIG. 8.

Figure 14B:
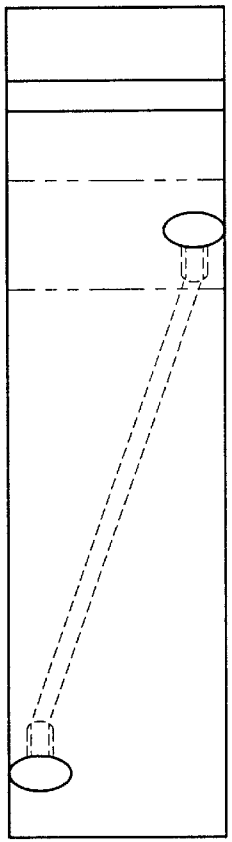
Figure 14A:
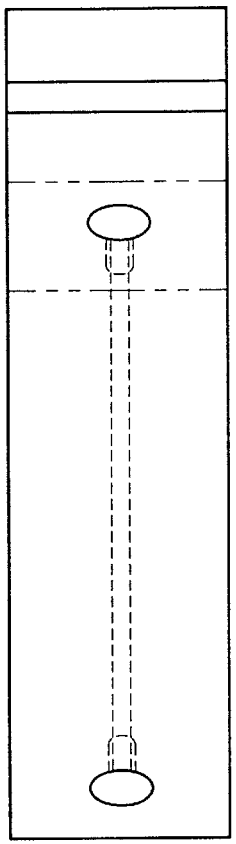

FIGS. 14*a* and 14*b* are schematic front views illustrating positions side-to-side of a single strand displaceable holding member.

Figure 15C:
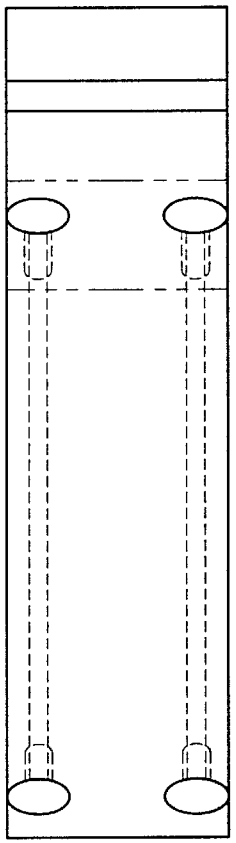
Figure 15B:
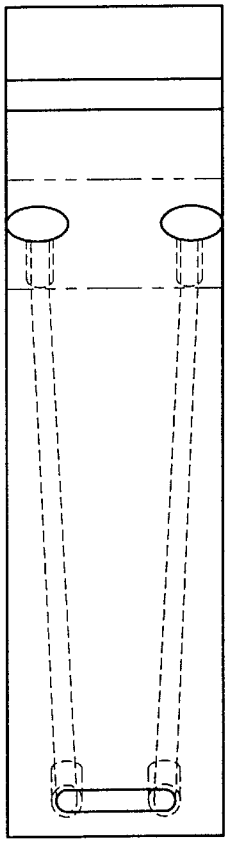
Figure 15A:
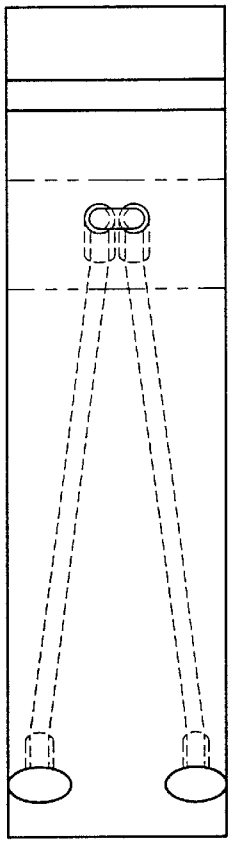

FIGS. 15*a* through 15*c* are schematic front reviews illustrating positions side-to-side for pairs of the displaceable holding strands.

Figures 16, 17, 18, 19:
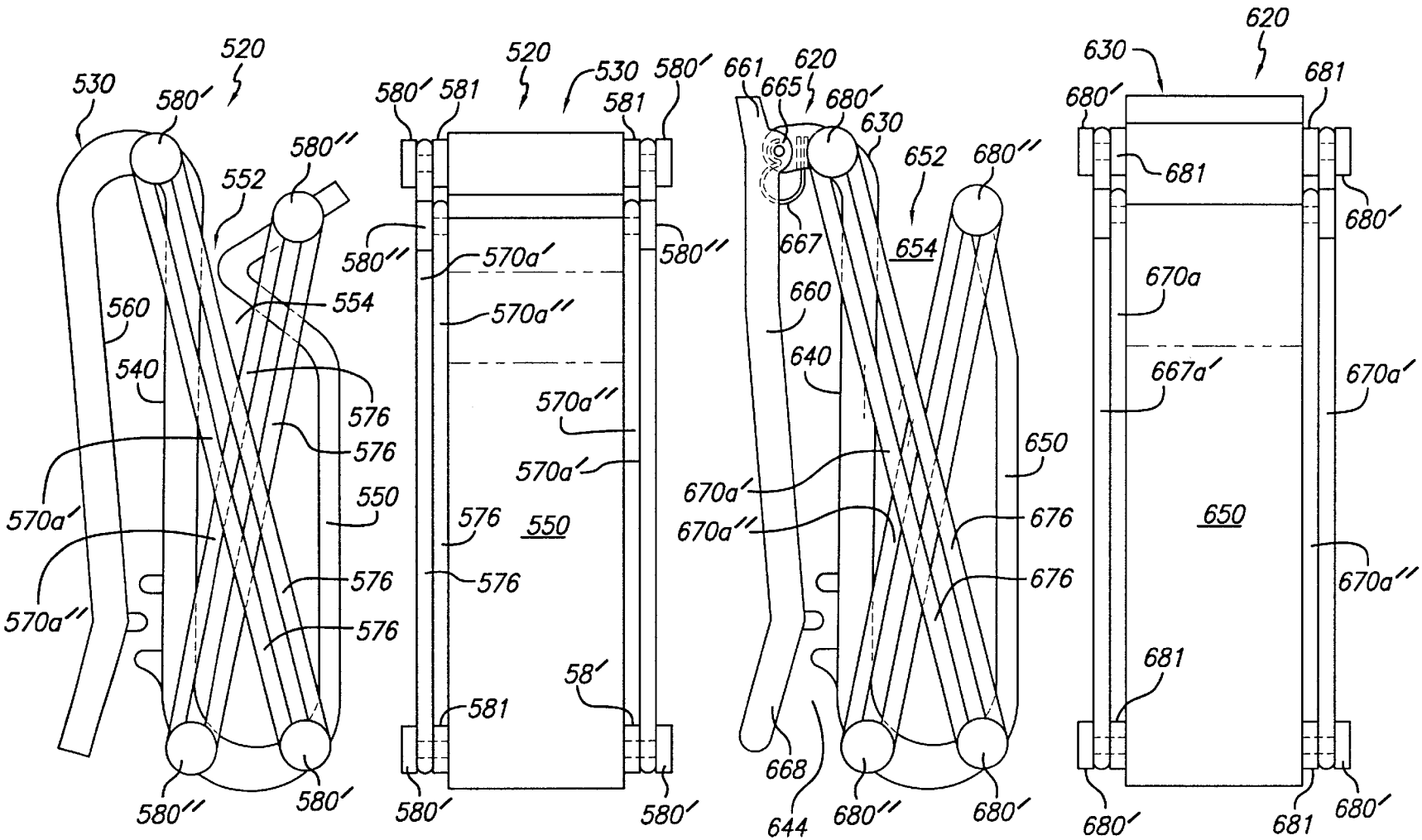

FIGS. 16 and 17 are schematic side and front views of another alternative preferred embodiment of the holder having multiple crossed loops at either side of the holder.

FIG. 18 and 19 are schematic side and front views of another alternative preferred embodiment of the holder having multiple crossed loops at either side of the holder, and with a fixed-gap, non-closing entrance.

Figure 20:
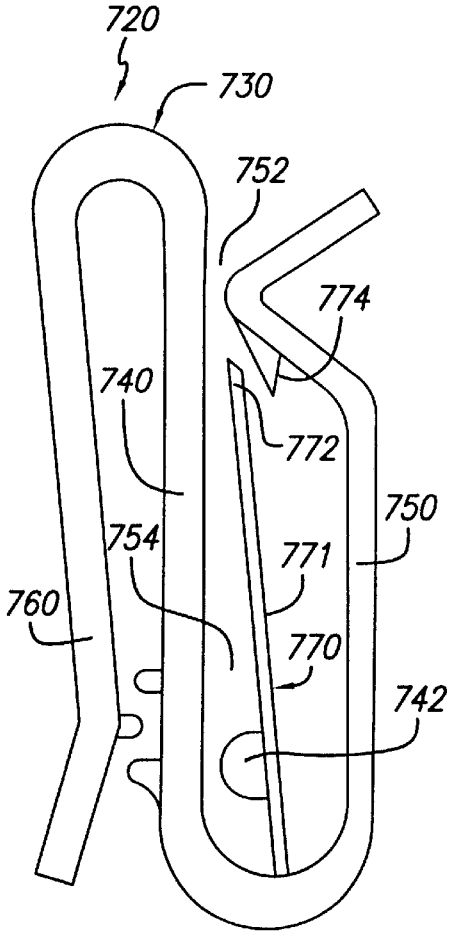

FIG. 20 is a schematic side view of another alternate preferred embodiment of the holder wherein the displaceable holding member is integrally formed with the rest of the frame, shown as the frame comes from the mold.

Figure 21:
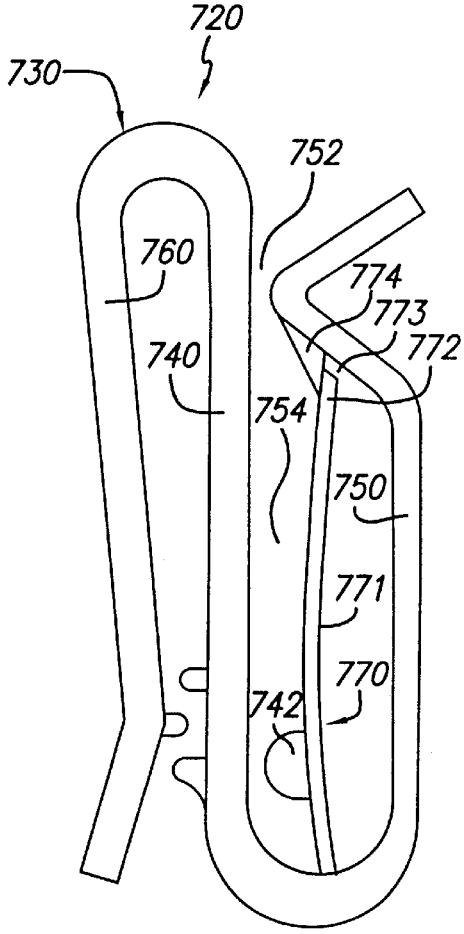

FIG. 21 shows the frame of FIG. 20 , with the frame in its operative condition.

Figure 22:
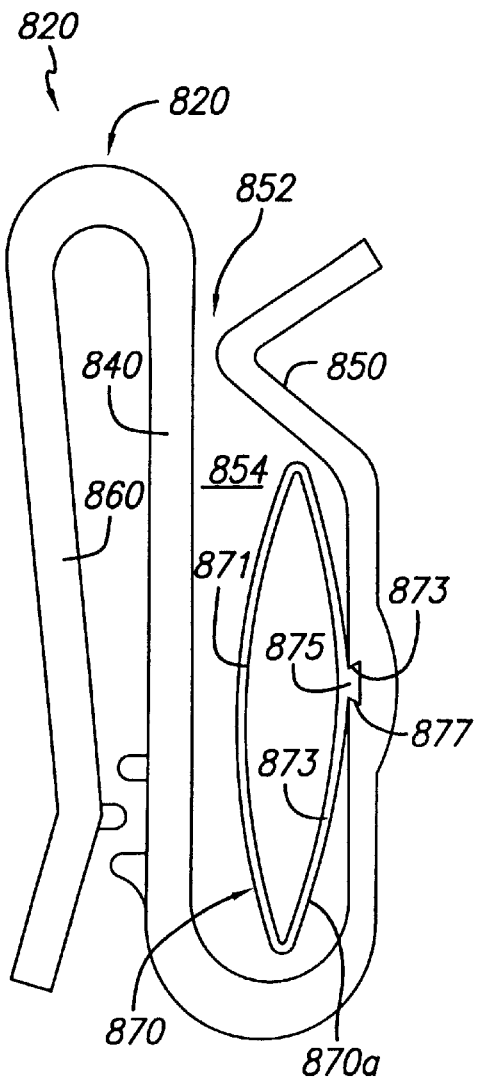

FIG. 22 is a schematic side view of another alternative preferred holder wherein the displaceable holding member is a separate piece in the form of a compression spring.

Figure 23:
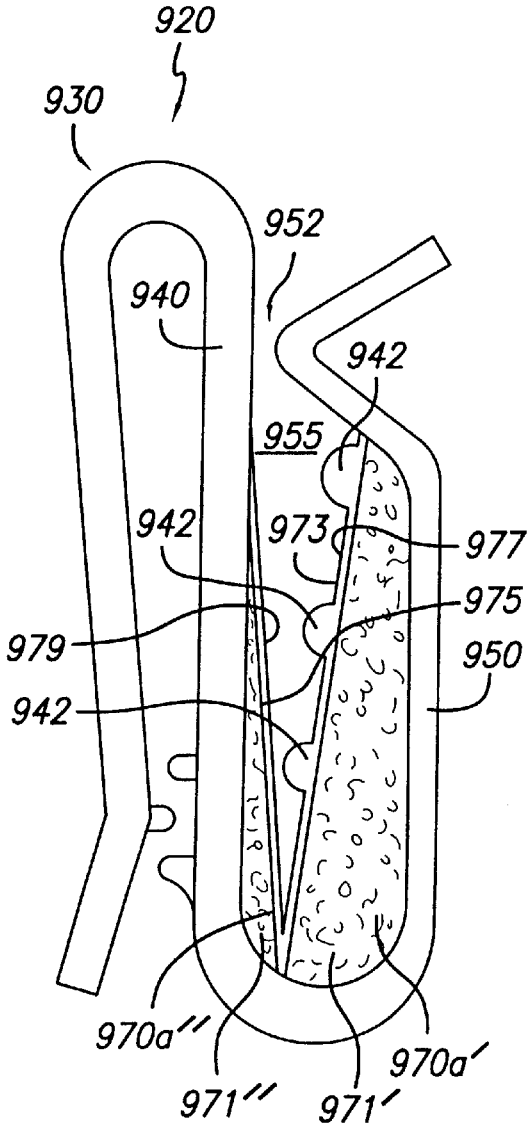

FIG. 23 is a schematic side view of another alternative preferred holder wherein the displaceable holding member is in the form of resilient foam.

DETAILED DESCRIPTION OF THE DRAWINGS

FIGS. 1–7 illustrate a presently preferred embodiment of an eyeglasses holder or carrier 20. Eyeglasses that may be held include a wide range of forms for various uses, including sunglasses. Broadly, the illustrated holder 20 includes a frame 30 formed from a single piece of somewhat flexible and resilient material such as plastic or metal, and a displaceable retaining member 70 in the form of an elastic band 70*a* mounted on the frame. The holder 20, which has opposed ends and opposed sides, is preferably supported by the belt or waistband of the user with its sides generally upright and an entrance 52 at its upper end for the eyeglasses. The holder will be described used this way and in this orientation for convenience, although the holder might be used in other ways and orientations.

Figure 4:
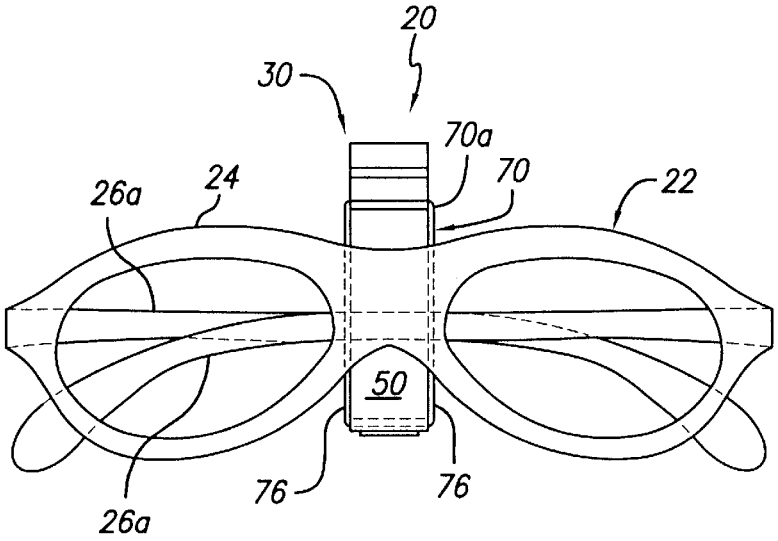
FIGS. 4 and 5 are front and side views of the holder of FIG. 1, showing a pair of regular eyeglasses held by the holder.
Figure 6:
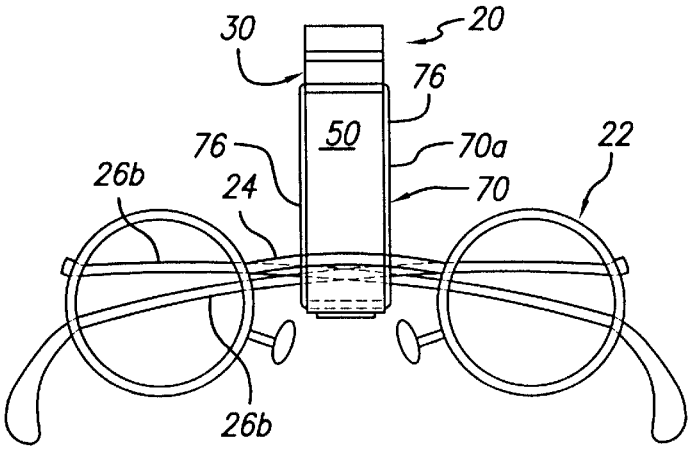
FIGS. 6 and 7 are front and side views of the holder of FIG. 1, showing a pair of thin frame eyeglasses held by the holder.

The upright frame 30 includes a base section 40 which is generally aligned with and connected at its lower end to a holding section 50. The upper ends of the sections are unconnected to provide the entrance 52 to a receiving space 54 defined between those sections. The receiving space 54 extends transversely from side to side of the frame and is open at either side. The base section 40 is to the rear or back adjacent to the user and the holder section 50 is forward or to the front away from the user. This allows the crossed temple bars or arms 26 of a pair of eyeglasses 22 to be oriented generally horizontally and inserted downwardly into the receiving space 54 through the entrance 52. The eyeglasses arms 26 extend outwardly to either side of the frame as shown in FIGS. 4 and 6. The resiliency of the illustrated frame 30 allows the entrance 52 to be temporarily enlarged to an opened condition as one or both of the sections 40, 50 flex away from one another as the eyeglasses arms 26 are pressed downwardly into and through the entrance 52 into the receiving space 54. Preferably the holder section 50 is thinner than the base section 40 and will provide the majority of the flexing. The entrance 52 then returns to a closed condition sufficiently small to bar passage of the arms 26. The eyeglasses brim section 24 extends generally horizontally in front of the holder (FIGS. 4 and 6).

Figure 1:
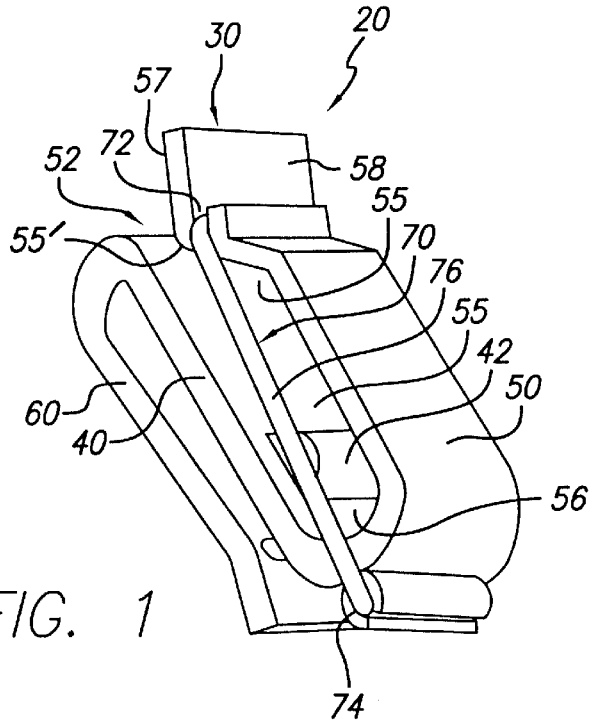
FIG. 1 is a perspective view of a presently preferred embodiment of the eyeglasses holder of the invention.
Figure 2:
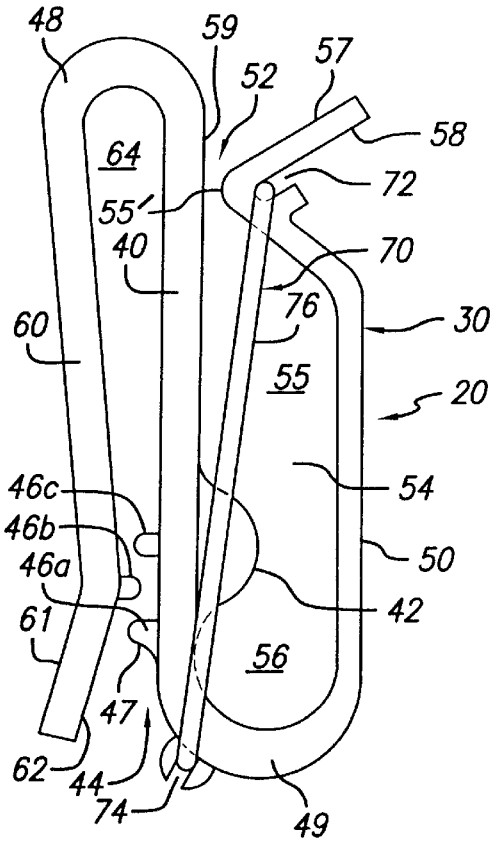
FIG. 2 is a side view of the holder of FIG. 1.
Figure 3:
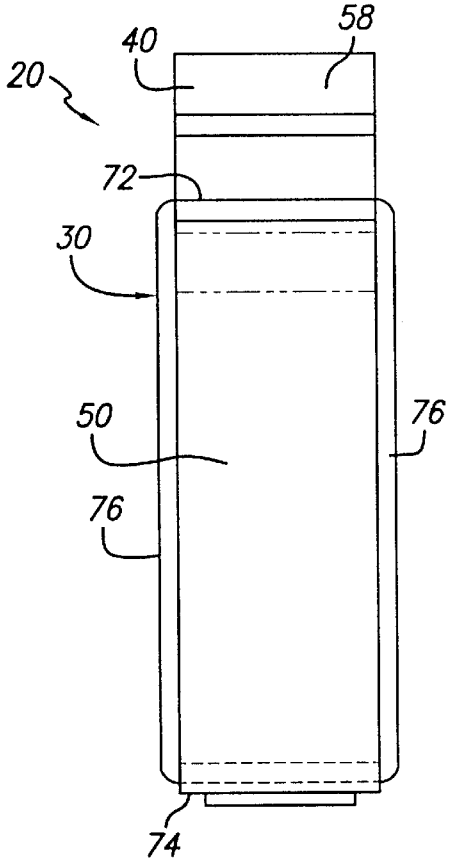
FIG. 3 is a front view of the holder of FIG. 1.

The illustrated displaceable holding or retaining member 70 is in the form of the single continuous O-ring, loop or band 70*a* of an elastic material such as Silicone. The illustrated band 70*a* is supported at either end of the frame 30 in a retaining slot 72, 74 so that a length or strand 76 of the band 70*a* extends generally along each side of the frame 30 in the end-to-end direction. FIG. 2 shows the strands 76 traversing the receiving space 54 so that when the eyeglasses arms 26 are inserted into the space 54, the strands are engaged, displaced and stretched by the arms. This causes the strands 76 to exert, in combination with the frame, a frictional holding force against the arms, which acts limit their movement and to hold them and the eyeglasses in place. The illustrated strands 76 are tilted or inclined from the vertical, being closer to the base section 40 at the bottom and further from it at the top adjacent to the entrance 52.

Figure 5:
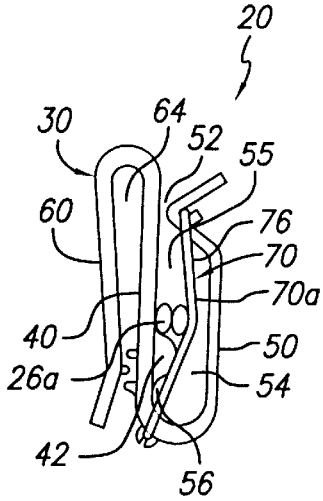
Figure 7:
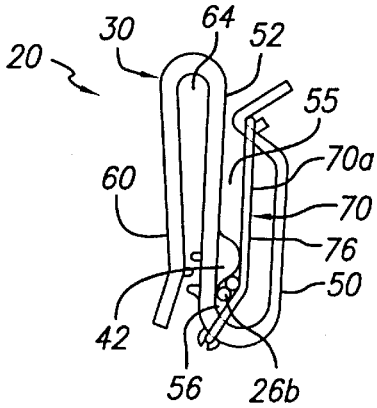

The illustrated frame 30 also includes a dividing projection 42 formed on the base section 40. The projection 42 extends into and divides the space 54. FIGS. 2–7 show the holder 20 in the orientation in which it will usually be used where the entrance 52 is at the top and opens upwardly. The projection 42 forms a larger upper subspace 55 for accommodating thicker eyeglasses arms 26*a* as shown in FIGS. 4 and 5. Projection 42 also forms a lower subspace 56 for accommodating thinner eyeglasses arms 26*b* as shown in FIGS. 6 and 7. In this case, the thinner arms 26*b* will move past the dividing projection 42 into the lower subspace 56. The retainer strands 76 operate to maintain the eyeglasses arms in the selected subspace.

The illustrated frame 30 further includes a support section 60 which is also generally aligned with the base section 40. The support section 60 is connected to the base section 40 at the upper end of the base section 40. These sections 40,60 are generally spaced away from one another to provide a receptacle 64, and the sections are unconnected at their lower ends to provide a downwardly opening entrance 44. The base and support sections 40, 60 thus provide a clip-on for supporting the frame 30 on the belt or waistband of the user. The holder could also for example be mounted on an upwardly opening shirt or coat pocket of the user. It could be mounted other than on the user's clothing as for storage or display. Other support means such as a detachable strap or a "velcro" type interconnection could also be used.

The receiving space 54 is large enough to accommodate larger eyeglasses arms 26*a* in a subspace space 55 while also, because of the action of the retainer member 70, being able to accommodate a wide range of sizes of eyeglasses arms, including thinner arms in the subspace 56.

The holder 20 is designed to facilitate easy and ready passage through the entrance 52 in both directions. While the entrance 52 may be enlarged by having the user simply applying flexing force to the end 58 of the holding section 50 at the entrance, it is preferred that the holder be designed so that the user can, using one hand, simply press the eyeglasses arms 26 into the entrance 52 and thereby cause such enlargement. In this regard, holding section end 58 is angled to provide a guiding or camming surface 57 that has a curved edge 55' at the entrance 52. As the arms 26 are pressed downwardly into the entrance 52, they are initially guided into the entrance 52 by angled surface 57. They also wedge or press against the forward surface 59 of the upper end of the base section 40 and the curved edge 55' of the upper end 58 of the holding section 50 so as to flex the section 50 forwardly and enlarge the entrance 52. This allows passage of the arms through the entrance 52. Similarly, when the user wishes to remove the eyeglasses from the holder, she may simply and easily move the arms upwardly into the entrance 52 to again engage the curved edge 55' and spread open the entrance 52.

Similarly, a projection 46*a* at the entrance 44 may have a gradually sloped or angled guide surface 47 to accommodate insertion of the user's belt or waistband through that entrance. The lower end portion 61 of the support section 60 is angled slightly away from the entrance 44 to provide an inclined surface 62 to further facilitate insertion of the waistband into the entrance 44.

Retention of the holder 20 on the belt or waistband of the user is enhanced by three small inward projections 46*a*, 46*b* and 46*c* on the base and support sections 40, 60 near the entrance 44. More particularly, when the waistband has been inserted into the receptacle 64 and the lower ends of the base and support sections 40, 60 at the entrance 44 are allowed to contract toward one another, the projections 46*a*, 46*b* and 46*c* grasp and hold the waistband in place.

Where the base section 40 and the holding section 50 are connected together at the lower end of the frame 30, there is an arcuate or curved connecting end section 49. End section 49 has a substantially greater cross-section than either base or holding sections 40, 50, whereby at least the bulk of the flexing of the frame 30 to enlarge the entrance 52 takes place in the holding and base sections 50, 40 rather than in the end section 49. This arrangement of thickness reduces the stress that would normally fall on end section 49, and spreads that load over the much larger surface areas of sections 40 and 50. This reduces the risk of permanent deformation, cracking or breakage at the end section 49 from repeated flexing to opening the entrance 52. Preferably holder section 50 has a smaller thickness than base section 40, and so performs most of the flexing. Similarly, connector end section 48 is thickened where the base section 40 joins the support section 60 at the top of the holder.

The mounting of the displaceable holding loop 70*a* in the open transverse slots 72 and 74 facilitates easy replacement of the loop. Use of the loop 70 of the presently preferred embodiment is a simple, efficient and economical arrangement which provides a pair of spaced apart retaining strands 76 that engage the eyeglasses arms at spaced apart locations to hold the eyeglasses in place, particularly against rotational movement about a vertical axis.

Applicant has built an effective working model of the holder embodiment described above. That model holder has a height of about 2 inches, a width of about three-fourths of an inch and a depth of about three-fourths of an inch. In its closed condition, the gap between the separated ends of the base and holder sections is about 1/16 of an inch, the maximum depth of the receiving space is about one-half of an inch, and the length of that space is about 1¼ inches. Under opening pressure the gap can open to about ¼ of an inch or more. The holding or retaining loop or band has a non-stressed diameter of about 1 inch, and when it is mounted on the frame extends to about 1 and three-quarter inches.

In selecting the material for the frame, certain desirable properties or characteristics were considered. First, the material should have a good memory. That is, even after it remains in a flexed condition for an extended period of time, the material should return to its original condition when the flexing pressure is removed. This is particularly important for the action of the clip for the user's belt or waistband provided by the base and support section where the material may remain classics for a long period of time.

Second, the material desirability is strong enough to offer good resistance when flexed to the open condition. This is important to provide a firm grip on the user's waistband, and also to adequately hold the eyeglasses.

Third, it is desirable that the material not be brittle so that it does not snap apart if excessive flexing force is inadvertently applied to the material.

Further, it is desirable that the material not scratch or otherwise damage the plastic eyeglass frames or the eyeglass lenses from repeated contact with them.

Of various materials tried, Acetyl plastic provides the best combination of desirable characteristics: it has very good memory, good strength, is not brittle, and does not scratch the eyeglass frames.

Nylon has good memory, good strength, but if severely over-flexed, it will snap apart. Also, after continuous use it will scratch the eyeglass frames.

Polypropylene has fair memory, fair strength, is not brittle and does not scratch the eyeglass frames.

Polypropylene plus glass and filler has improved memory, improved strength, is not brittle, and does not scratch the eyeglass frames.

ABS is not brittle and does not scratch the eyeglass frames, however it has inferior strength and bad memory.

The O-ring material used in the holder model was Silicone. It has very good elasticity, is good in a sunny swimming environment, being resistant to ozone and chlorine, and is the presently preferred material. Other rubber based materials provided adequate elasticity, however black rubber skid marks were left on some textured eyeglass frames. Another possible material for the O-ring is polyurethane, but it is very expensive.

Figure 7A:
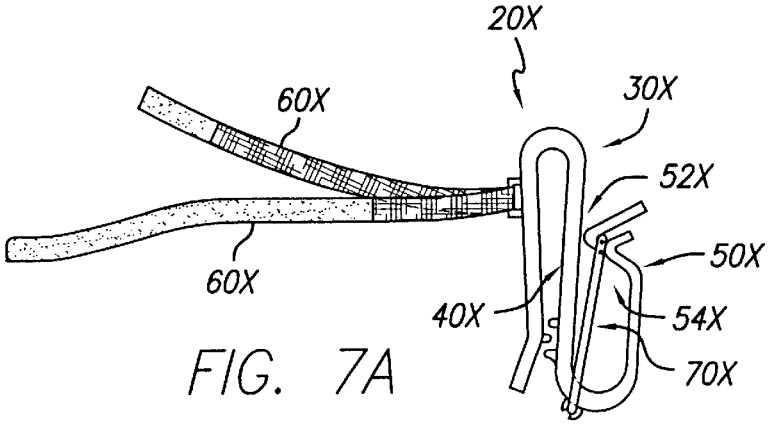
FIG. 7A is a schematic side view of an alternate form of holder wherein the holding section is shortened.

FIG. 7A shows a holder 20*x* which is similar to holder 20, but the holder section 50*x* is substantially shorter than the base section 40*x*. Further the holder 20*x* has support means in the form of a band 60*x* with fastening ends of Velcro or other connecting means to releasibly support the holder 20*x* as on the wrist or arm of the user.

FIGS. 8, 9 and 10 illustrate another form of holder 120 that utilizes a displaceable holding or retaining member 170 that is a single-strand 176. The single-strand 176 has a small loop 177 each end (see FIG. 9) that fits upon an associated projection with an enlarged head 180 (FIG. 9) at one end of the frame 130 to hold the single-strand 176 in place. The single-strand 176 extends generally along the center of the frame 130 from end-to-end. At the lower end of the frame 130, the strand 176 passes through an opening 179. As seen in FIG. 8, the strand 176 inclines front-to-back away from the base section 140 at the upper entrance 152 and toward the holder section 150 at the lower end of the holder. This is opposite the incline of the strands 76 of holder 20 (see FIG. 2). The single-strand 176 is readily removable and replaceable.

Figure 11:
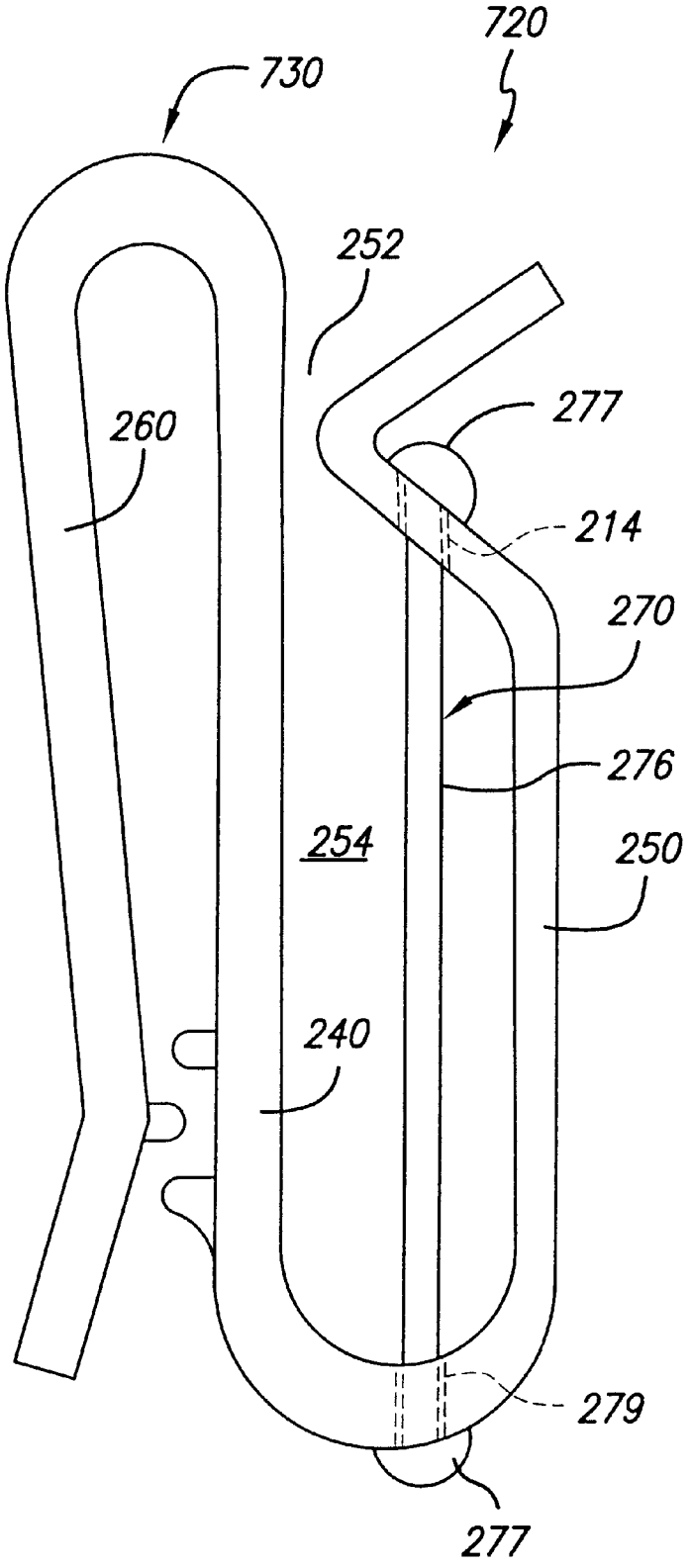
FIG. 11 is a schematic side view of another alternate eyeglasses holder having a single holding strand with a connecting enlargement at either end.

FIG. 11 illustrates another form of holder 220 that also utilizes a holding or retaining member 270 in the form of a single-strand 276. The strand 276 has an enlargement 277 at each end. The frame 230 is provided with a suitable hole 279 at either end, through which the associated enlargement 277 may be pushed to thereby hold the strand 276 in position. The strand 276 extends generally down the middle side-to-side, and also generally down the middle and parallel to the sections 240 and 250 front-to-back.

Figure 12:
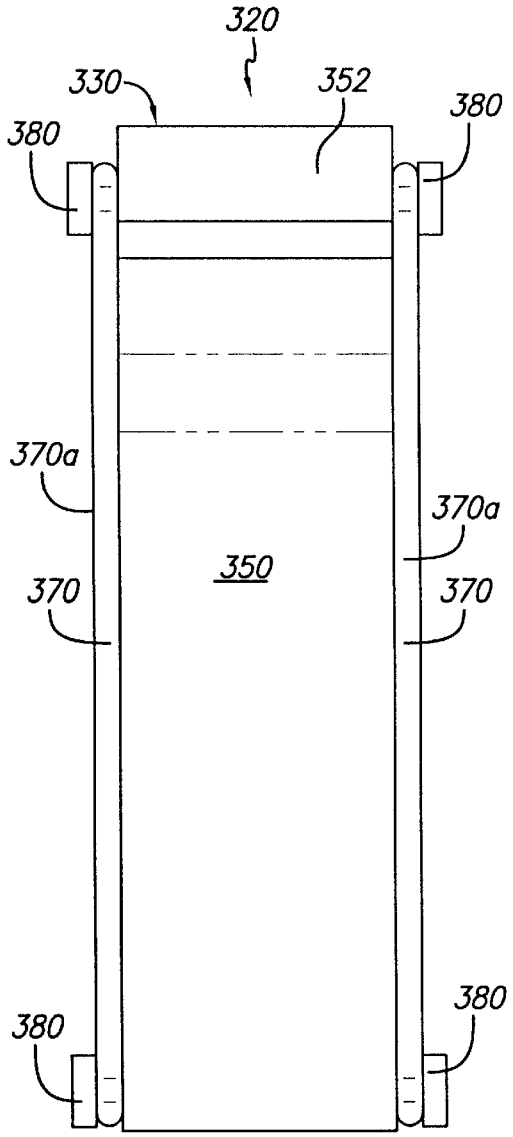
FIG. 12 is a schematic front view of an alternative preferred embodiment of the holder wherein a separate small loop is supported outwardly at either side of the frame to provide the holding strands.
Figure 13:
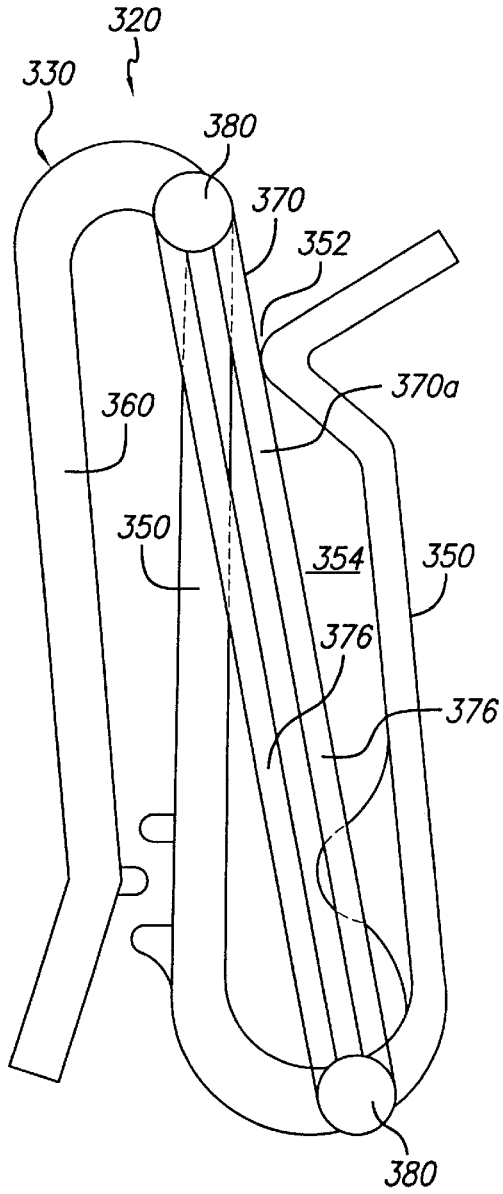
FIG. 13 is a schematic side view of the holder of FIG. 12.

FIGS. 12 and 13 show a holder 320 which uses a pair of small loops or O-rings 370, each supported along one side of the frame 330. Each O-ring 370 is removably mounted on a pair of spaced apart fingers or projections with enlarged heads 380 located at opposite ends of one side of the frame 330. As shown in FIG. 13, the strands 376 of the loops 370 are inclined front-to-back like the strand 176 of FIG. 8.

FIGS. 14*a*–14*b* and 15*a* through 15*c* are schematic front views showing several different positions side-to-side of one or more holding strands.

FIG. 14*a* shows a single strand extending generally vertically at about the center side-to-side of the frame, as provided by the embodiments 120 and 220 of FIGS. 8 through 11.

FIG. 14*b* illustrates a single strand angled side to side.

FIG. 15*a* illustrates a pair of strands spaced at the bottom and converging at the top. These strands are shown provided by a single cord that is doubled over into a generally V-shape and supported in that position by the frame.

FIG. 15*b* illustrates a pair of strands further spaced apart at the top than at the bottom. These strands are shown provided by a single cord that is doubled over into a generally U-shape and supported in that position by the frame.

FIG. 15*c* illustrates a pair of strands generally upright and parallel, but somewhat within the sides of the frame.

FIGS. 16 and 17 illustrate an eyeglasses holder 520 which is another presently preferred embodiment of the invention. At each side of the holder 520 a pair of smaller loops or bands 570*a*' and 570*a*" are supported. Each of the bands 570*a*', 570*a*" extends generally end-to-end and is supported at either of its end on a projection or pin with an enlarged head 580', 580". As shown in FIG. 17, at each side of the holder 520, one of the bands 570*a*' is supported by a pair of the projections 580' in a position that is more outwardly to the side than the other of the bands 570*a*" at that side. The projections 580' that support the outer bands 570*a*' each include a second enlargement 581 spaced inwardly from the outward end of the projection. The enlargements 580' maintain the supported bands 570*a*' in the desired outward positions. The more inward bands 570*a*" are each supported at one side by a pair of projections 580". At each side of the holder, the two bands 570*a*' and 570*a*" are inclined in opposite directions so that they cross or intersect about midway or halfway top-to-bottom of the receiving space 554 (see FIG. 16). Thus, when the arms 26 of a pair of eyeglasses are inserted through the entrance 552 and into the receiving space 554, the arms 26 are engaged and held in place at each side of the holder by the four crossed strands 576 of the two pair of bands 570*a*' and 570*a*" at that side of the holder.

FIGS. 18 and 19 illustrate a holder 630 which is another preferred embodiment of the invention. Holder 620 is similar to holder 520 of FIGS. 16 and 17 except that the entrance 652 is a wide, fixed-size opening that is generally large enough to receive eyeglasses arms 26 without having to flex or further enlarge. The pair the crossed pairs of bands 670*a* at either side of the holder 620 are relied upon to adequately engage and retain eyeglasses arms 26 that are pushed into the receiving opening 654. The frame 630 of the holder 620 may, if desired, be made him from a rigid non-flexing material since the frame is not required to flex to enlarge the entrance 652. Holder 630 illustrates an alternative support arrangement. The support section 660 is a separate piece that is pivotally connected at its upper end 661 to the upper end of base section 640 for rotation about a side-to side generally horizontal axis 665. The separate support section 660 is biased by a spring 667 so that its lower end 668 is urged toward the lower end of the base section 640 to provide a normally closed entrance 644. The entrance 644 may be enlarged by pivoting the support section 660 against the force of spring 667 to allow passage there through of the users waistband.

FIGS. 20 and 21 illustrate another form of presently preferred eyeglasses holder 720. In holder 720 the displaceable holding or retaining member 770 is in the form of a generally rectangular holding portion 771 that is integrally formed with the remainder of the frame 730. As shown in FIG. 20, the frame 730 is formed as by molding with the holding portion 771 connected at its lower end and extending upwardly within the receiving space 754. The illustrated portion 771 is then flexed, moved to and held in a generally curved or bowed condition by a locking tab 774 as shown in FIG. 21 .The bowed holding portion 771 serves to engage the arms 26 of a pair of eyeglasses 22 when they are inserted through the entrance 752 into the space 754. The bowed portion 771 functions as a compression spring pressing against the eyeglasses arms 26 to hold or retain the arms in the space 754 It will be noted that there is clearance space 773 between the free upper end 772 of portion 77 land the adjacent inner wall of the holding section 750 to accommodate straightening and lengthening of the portion 771 when it engages and is displaced by the arms 26 of the eyeglasses. The flexibility and resiliency of the frame material, and the configuration and location of the holding portion 771 may be selected to provide suitable holding of the eyeglasses arms without damaging the eyeglasses or the portion 771 itself through repeated use. The dividing projection 742 is provided on the front face of the holder portion 771.

It would also be possible to use other specific configurations and locations for one or more spring-like holding or retaining portions that are integrally formed as part of a one-piece frame.

It would also be possible to utilize one or more spring-like holding elements that are separate parts, connected during the manufacture/assembly process to the remainder of the frame. The such spring-like holding elements may be made of a suitable material such as metal or flexible resilient plastic.

FIG. 22 shows a holder 820 wherein the holding or retaining member 870 is in the form of a separate compression spring 870*a*. The spring 870*a* has a curved or arcuate displaceable retainer portion 871 and a curved or arcuate attachment portion 873. The spring 870*a* is shown supported in the receiving space 854 with the displaceable retainer portion 871 extending generally end-to-end and positioned so as to engage the arms 26 of a pair of eyeglasses when the arms are inserted into the receiving space 854. The attachment portion 873 may be connected to the rear of the holding section 850 by various means. FIG. 22 illustrates the use of a transverse rib 875 on the attachment portion 873 that is received in a matting slot 877 in the rear wall of the holding section 850.

Other connecting means such as fasteners, adhesives or mechanical locking bands may be used. The compression spring 870*a* may be made of a suitable material such as metal or flexible resilient plastic.

FIG. 23 illustrates a holder 920 which is another preferred embodiment. In holder 920 the displaceable holding or retaining member is provided by two inserts 970*a*' and 970*a*". The inserts 970*a*' and 970*a*" each have a core 971', 971 " made of a flexible, resilient but relatively firm and shape-retaining material such as closed-cell foam. Such material has good memory, tending to return to return to its original form when pressure on it is removed. It also offers good resistance. The larger forward insert 970*a*' may be secured as with an adhesive to the inward face of the holding section 950. The smaller rearward insert 970*a*" may similarly be secured to the inner face of the base section 940. Each of the inserts 970*a*' and 970*a*" has an inclined inner contact surface 973, 975, respectively. The rear contact surface 975 inclines forwardly away from the base section as that contact surface extends downwardly. The front contact surface 973 inclines rearwardly away from the holder section 950 as that contact surface extends downwardly. Thus the contact surfaces 973, 975 converge toward one another as the extend downwardly to form a generally wedge or v-shape. The illustrated inserts 970*a*' and 970*a*" each also include a flexible protective layer 977, 979 of a material such as rubber which provides the respective contact surface 973,975. The inserts may include one or more transverse dividing ribs or projections 942. FIG. 23 illustrates three spaced apart projections 942 integrally formed on the rear face of layer 977. Eyeglasses arms 26 inserted into the receiving space 955 will press or wedge against the opposed contact surfaces 973,975, which compresses and displaces the contact surfaces, creating holding frictional contact between the arms and the contact surfaces. This limits movement of the arms and the eyeglasses. This embodiment illustrates that "displaceable" as used herein requires significant displacement, movement or flexing of the surface that engages the eyeglasses arms, but does not require such displacement of the entire holding member, although the entire holding member may be displaced as in the case of elastic strands.

Various other modifications and changes may be made to the illustrated structure without departing from the spirit and scope of the invention as set forth in the following claims.

What is claimed is:

1. A holder for eyeglasses comprising:

a) a frame integrally formed from a single piece of resilient material, said frame having a pair of opposed ends and a pair of opposed sides, said frame comprising:

1) a base section having a first end and a generally opposed second end, and a pair of opposed sides, 2) a holding section having a first end and a generally opposed second end and a pair of opposed sides, said base and holding sections being configured to form a receiving space defined between opposed inner surfaces of said base and holding sections and extending from side to side of said sections, for receiving therein the crossed arms of a pair of eyeglasses, said base and holding sections being joined together generally at said first ends, and a second end of one of said sections being separated from the other of said sections to form an entrance into and out of said receiving space, said second end being normally in sufficiently close proximity to said other of said sections to bar passage of the arms through said entrance, but being movable away from said other of said sections by flexing of at least one of said sections to enlarge said entrance to allow movement by the eyeglasses arms through said entrance and in and out of said receiving space, and b) at least one displaceable holding member supported by said frame, said displaceable member being positioned to be engaged and displaced by the crossed eyeglasses arms when the arms are inserted into said space, said member exerting, in combination with said frame, a frictional holding force on the arms for limiting movement of the arms in said space.

2. The holder of claim 1 wherein said holding member extends generally end-to end of said holder.

3. The holder of claim 2 wherein said holding member is comprised of at least one elastic strand, said strand stretching when it is engaged and displace by the eyeglasses arms.

4. The holder of claim 2 wherein there are at least two of said holding members that are spaced side-by-side apart from one another.

5. The holder of claim 4 wherein said holding members are elastic strands.

6. The holder of claim 5 wherein said at least two strands are provided by a continuous loop.

7. The holder of claim 6 wherein said loop is supported on said frame so that a portion of said loop extends along each side of said frame to provide said spaced apart strands.

8. The holder of claim 7 wherein said frame is formed at each end with an elongated receptacle that extends generally transversely side-to-side and opens generally outwardly away from its end of said frame, portions of said loop being releasibly received in said receptacles.

9. The holder of claim 2 wherein said holding member is a single strand.

10. The holder of claim 9 wherein said single strand extends generally parallel to the sides of said holder and is generally centered between said sides.

11. The holder of claim 9 wherein said single strand extends diagonally from side-to-side.

12. The holder of claim 3 wherein said at least one strand has an enlargement at either end and said frame has an opening at either end for receiving one end of said at least one strand.

13. The holder of claim 3 wherein said at least one strand has an end loop at either end and said frame has a projection at either end for receiving one of said end loops thereabout.

14. The holder of claim 2 wherein said holding member is inclined between said holding section and said base section toward one of said sections and away from other of said sections.

15. The holder of claim 14 wherein said holding member is inclined from said holding section toward said base section.

16. The holder of claim 14 wherein said holding member is inclined from said base section toward said holding section.

17. The holder of claim 4 wherein each of said holding members is at about one side of said frame.

18. The holder of claim 4 wherein each of said holding members is positioned outwardly to the side of said frame.

19. The holder of claim 4 wherein said two holding members are further spaced apart at one end of said holder than at other end of said holder.

20. The holder of claim 2 wherein said holding member is integrally formed with remainder of said frame.

21. The holder of claim 19 wherein one end of said holding member is connected to the remainder of said frame and the other end of said holding member is in engagement with said remainder of said frame in a manner causing said retaining member to assume a flexed, curved condition, said engagement allowing said holding member to be moved to a less curved condition when engaged by eyeglasses arms that are inserted into said receiving space.

22. The holder of claim 2 wherein said holding member a separate piece connected to said frame.

23. The holder of claim 22 wherein said holding member is a compression spring with a pair of opposed outwardly-curved plate portions.

24. The holder of claim 5 wherein said elastic strands are in the form of at least one pair of crossed strands at each side of said frame.

25. The holder of claim 24 wherein each said pair of crossed strands includes at least one strand that is supported outwardly to the side of the other strand of said pair.

26. The holder of claim 25 wherein each of said pair of crossed strands at each side includes a pair of continuous loops.

27. The holder of claim 1 wherein said frame is made of Acetyl plastic.

28. The holder of claim 3 wherein said strand is made of Silicone.

29. The holder of claim 1 wherein said frame is about 2 inches end-to-end, about ¾ of an inch side-to-side, and about ¾ of an inch front-to-back.

30. The holder of claim 1 wherein one of said sections includes at least one inwardly extending projection to partially define, with said sections and said holding member, a more limited receiving space for thin eyeglass arms.

31. The holder of claim 1 wherein the area of said frame where said sections are joined is substantially thicker that the thickness of the remainder of at least one of said sections.

32. The holder of claim 1 wherein said frame also includes an attachment section that has a pair of opposed ends, one of said ends of said attachment section being connected to one of said ends of said base section to form a flexible attachment clip.

33. The holder of claim 32 wherein the other end of said attachment section is not connected to said base section to thereby form an attachment entrance for being directed downwardly to clip on a user's clothing such as a pant waistband.

34. The holder of claim 1 wherein, adjacent to said entrance, the end of at least one of said sections provides an inclined camming surface positioned to be engaged by the eyeglasses arms as they move into said entrance from the outside said receiving space to thereby enlarge said entrance and allow the arms to pass through said entrance into said space.

35. The holder of claim 34 wherein at least one of said sections also includes an inclined camming surface positioned to be engaged by the eyeglasses arms as they move to said entrance from said receiving space to thereby enlarge said entrance and allow the arms to pass through said entrance out of said space.

36. The holder of claim 1 wherein said displaceable holding member is comprised of at least one body of shape-retaining but flexible resilient material having a contact surface for being engaged and displaced by the arms when they are inserted into said receiving space.

37. The holder of claim 36 wherein said body material is a closed cell foam.

38. The holder of claim 36 wherein said body also includes a flexible protecting layer at said contact surface.

39. The holder of claim 36 wherein there are a pair of said bodies, each of said bodies having a contact surface, said contact surfaces being spaced apart and opposing one another.

40. The holder of claim 39 wherein said opposed contact surfaces are arranged in a generally wedge-shaped configuration such that the space between said contact surfaces decreases as one moves away from said entrance.

41. The holder of claim 1 wherein said holding section is generally aligned with said base section.

42. The holder of claim 1 wherein one of said sections is substantially shorted end-to-end than the other.

43. The holder of claim 1 wherein the engagement of said holding member with the eyeglasses arms is either within said receiving space, or to one or both sides of said receiving space, or both within and at one or both sides of said receiving space.

44. A three-section holder for eyeglasses integrally formed from a single piece of resilient material, said holder having a pair of opposed ends and a pair of opposed sides, said holder comprising:

1) a base section having a first end and a generally opposed second end, and a pair of opposed sides, 2) a holding section having a first end and a generally opposed second end and a pair of opposed sides, said base and holding sections being configured to form a receiving space defined between opposed inner surfaces of said base and holding sections and extending from side to side of said sections, for receiving therein the crossed arms of a pair of eyeglasses, said base and holding sections being joined together generally at said first ends, and a second end of one of said sections being separated from the other of said sections to form a entrance into and out of said receiving space, said second ends being normally in sufficiently close proximity to said other of said sections to bar passage of the arms through said entrance, but being movable away from said other of said sections by flexing of at least one of said sections to enlarge said entrance to allow movement by the eyeglasses arms through said entrance and in and out of said receiving space, and 3) at least one displaceable holding section connected to at least one of said other sections of said frame, said displaceable holding section being positioned to be engaged and displaced by the crossed eyeglasses arms when the arms are inserted into said space, said holding section exerting, in combination with at least one other section of said frame, a frictional holding force on the arms for limiting movement of the arms in said space.

45. A holder for eyeglasses comprising:

a) a frame having a pair of opposed ends and a pair of opposed sides, said frame comprising:

1) a base section having a first end and a generally opposed second end, and a pair of opposed sides, 2) a holding section having a first end and a generally opposed second end and a pair of opposed sides, said base and holding sections being configured to form a receiving space defined between opposed inner surfaces of said base and holding sections and extending from side to side of said sections, for receiving therein the crossed arms of a pair of eyeglasses, said base and holding sections being joined together generally at said first ends, and a second end of one of said sections being separated from the other of said sections to form an entrance sufficiently large for passage therethrough of the arms into and out of said receiving space, b) at least one displaceable holding member supported by said frame, said displaceable holding member being positioned to be engaged and displaced by the crossed eyeglasses arms when the arms are inserted into said space, said member exerting, in combination with said frame, a frictional holding force on the arms for limiting movement of the arms in said space.

46. A clip-on eyeglasses carrier comprising 1) a one-piece unitary frame with top and bottom ends, said frame being made of a flexible, resilient material, said frame forming a downwardly opening support receptacle at the frame bottom end for clipping onto the waistband of a user to support the carrier in a generally upright position with the frame top end uppermost, said frame also forming an upwardly opening eyeglasses receiving space for receiving the crossed arms of a pair of eyeglasses, said eyeglasses receiving space having an entrance that is normally too small for passage therethrough of the eyeglasses arms, said entrance being enlargable by flexing of said frame to an entrance size allowing passage therethrough of the arms, and 2) a displaceable holding member mounted on said frame and positioned so as to be engaged and displaced by the arms of the eyeglasses when the arms are inserted into said receiving space, said member then exerting a holding force on the arms to limit movement of the arms in said eyeglasses receiving space, said holding member extending generally end-to end of said holder, said holding member being comprised of at least one elastic strand, said strand stretching when it is engaged and displace by the eyeglasses arms.

47. A clip on eyeglasses carrier comprising:

1) a one-piece unitary frame with top and bottom ends, said frame being made of a flexible, resilient material, said frame forming a downwardly opening support receptacle at the frame bottom end for clipping onto the waistband of a user to support the carrier in a generally upright position with the frame top end uppermost, said frame also forming an upwardly opening eyeglasses receiving space for receiving the crossed arms of a pair of eyeglasses, said eyeglasses receiving space having an entrance that is normally too small for passage therethrough of the eyeglasses arms, said entrance being enlargable by flexing of said frame to an entrance size allowing passage therethrough of the arms, and 2) a displaceable holding member mounted on said frame and positioned so as to be engaged and displaced by the arms of the eyeglasses when the arms are inserted into said receiving space, said member then exerting a holding force on the arms to limit movement of the arms in said eyeglasses receiving space, said holding member extending generally end-to end of said holder, there being at least two of said holding members that are spaced side-by-side apart from one another.

48. The holder of claim 47 wherein said at least two strands are provided by a continuous loop.

49. A clip-on eyeglasses carrier comprising:

1) a one-piece unitary frame with top and bottom ends, said frame being made of a flexible, resilient material, said frame forming a downwardly opening support receptacle at the frame bottom end for clipping onto the waistband of a user to support the carrier in a generally upright position with the frame top end uppermost, said frame also forming an upwardly opening eyeglasses receiving space for receiving the crossed arms of a pair of eyeglasses, said eyeglasses receiving space having an entrance that is normally too small for passage therethrough of the eyeglasses arms, said entrance being enlargable by flexing of said frame to an entrance size allowing passage therethrough of the arms, and 2) a displaceable holding member mounted on said frame and positioned so as to be engaged and displaced by the arms of the eyeglasses when the arms are inserted into said receiving space, said member then exerting a holding force on the arms to limit movement of the arms in said eyeglasses receiving space, said displaceable holding member being comprised of at least one body of shape-retaining but flexible resilient material having a contact surface for being engaged and displaced by the arms when they are inserted into said receiving space, there being a pair of said bodies, each of said bodies having a contact surface, said contact surfaces being spaced apart and opposing one another.

* * * * *